US006227680B1

(12) United States Patent
Arndt

(10) Patent No.: US 6,227,680 B1
(45) Date of Patent: May 8, 2001

(54) TAMPER RESISTANT LAMP

(75) Inventor: Michael A Arndt, Franklin, WI (US)

(73) Assignee: Schumaker Lighting, Inc., Milwaukee, WI (US)

( * ) Notice: Subject to any disclaimer, the term of this patent is extended or adjusted under 35 U.S.C. 154(b) by 0 days.

(21) Appl. No.: 09/120,350

(22) Filed: Jul. 21, 1998

(51) Int. Cl.[7] ..... F21V 1/00

(52) U.S. Cl. ..... 362/248; 362/417; 362/355; 362/356; 362/376; 362/377

(58) Field of Search ..... 362/417, 355, 362/356, 376, 377, 378, 248, 246, 228

(56) References Cited

U.S. PATENT DOCUMENTS

| | | | | |
|---|---|---|---|---|
| 4,626,972 | * | 12/1986 | Wolf | 362/251 |
| 5,023,522 | * | 6/1991 | Mansour | 315/291 |
| 5,174,648 | * | 12/1992 | Clary | 362/228 |
| 5,392,204 | * | 2/1995 | Schumaker | 362/294 |
| 5,611,618 | * | 3/1997 | Sawyer | 362/417 |
| 5,702,180 | * | 12/1997 | Huang | 362/410 |

* cited by examiner

*Primary Examiner*—Cassandra Spyrou
*Assistant Examiner*—Leo Boutsikaris
(74) *Attorney, Agent, or Firm*—Ryan Kromholz & Manion, S.C.

(57) ABSTRACT

An institutional lamp includes several features to enhance lamp longevity and safety in an institutional setting. A diffuser/guard assembly fully surrounds the lamp bulbs to prevent casual disassembly or inadvertent contact with the bulbs. An auxiliary socket is provided that can be conveniently used to power other devices. A night light bulb is included and is also located within the diffuser/guard assembly. When so located, the lamp continues to provide a natural appearing illumination when the night light feature is used. An easy to use rocker switch is provided to enhance user operating convenience, and a durable, plastic lampshade avoids the types of damages frequently suffered by cloth shades. Preferably, the lamp is constructed of heavy, durable materials to improve durability. However, the lamp is styled and decorated to have the type of inviting appearance commonly associated with lamps intended for use in the home.

13 Claims, 2 Drawing Sheets

TAMPER RESISTANT LAMP

BACKGROUND OF THE INVENTION

This invention relates generally to electric lamps and, more particularly, to electric lamps suitable for use in institutional housing settings.

The institutional housing market includes such institutions as colleges and universities, nursing homes, hospitals and military barracks. Typically, these institutions provide housing for people who do not directly own or rent their units and do not provide their own furnishings. Rather, it is up to the institution to provide the furnishings for the individual housing units.

Generally, such institutions seek to provide furnishings that create a home-like rather than institutional atmosphere. Although this can be easily achieved by using standard furnishings intended for use in the home, the realities of institutional use frequently render such home furnishings unacceptable for a number of reasons. Furnishings used in an institutional setting are typically subjected to greater use and abuse than their counterparts in the home. Accordingly, they are generally constructed of heavier and more durable materials than standard home furnishings. Similarly, they are sometimes the subject of deliberate acts of vandalism, which further necessitates durable construction. Finally, in the case of residents whose physical or mental condition makes the possibility of self harm a real concern, institutional furnishings must take such concerns into account.

One aspect of institutional furnishing that contributes greatly to creating a home-like setting and feel is lighting. Through the use of appropriate lamps and lighting fixtures, it is possible to create a warm, home-like setting and feel. However, lamps and fixtures, by their very nature, are often fragile, easily damaged items, particularly when designed for home use. Such lamps are easily disassembled or damaged making them attractive to vandals, senile patients or others who might intentionally or unintentionally subject the lamp to treatment not ordinarily encountered in the home. A robust, heavy-duty construction that would otherwise stand up to such use and abuse, however, works counter to the soft, warm, home-like feel that is sought to be created. Lamps and fixtures intended for use in the institutional housing market therefore need to address competing, and often contradictory, concerns.

SUMMARY OF THE INVENTION

The invention provides a tamper resistant lamp including a support, a light bulb mounted on the support, a harp assembly mounted on the support adjacent the light bulb for supporting a lampshade, and a rigid, light transmissive, diffuser/guard assembly coupled to the harp and substantially fully enclosing the light bulb for resisting unauthorized access to the light bulb while permitting the passage of light through the diffuser/guard assembly.

The invention also provides an institutional lamp having a base, a support column extending upwardly from the base, a diffuser positioned at an end of the support column opposite the base, a primary light bulb disposed within the diffuser, a secondary light bulb also disposed within the diffuser and operable to develop a lesser quantity of light than the primary light bulb, and an electrical switch operable to selectively actuate either or none of the primary and secondary light bulbs.

The invention also provides an institutional lamp having a base, a support column extending upwardly from the base, a harp assembly mounted on the support column opposite the base, a diffuser positioned at an end of the support column opposite the base, a primary light bulb disposed adjacent the harp assembly, a secondary light bulb also disposed adjacent the harp assembly and operable to develop a lesser quantity of light than the primary light bulb, an electrical switch operable to selectively actuate either or none of the primary and secondary light bulbs, a rigid, light transmissive, diffuser/guard assembly coupled to the harp and substantially fully enclosing the primary and secondary light bulbs for resisting unauthorized access to the light bulbs while permitting the passage of light through the diffuser/guard assembly, a lampshade mounted to the harp assembly substantially encircling the diffuser/guard assembly, and a locking finial engaging the harp assembly for securing the lampshade to the harp assembly, the locking finial including a locking element for resisting unauthorized disengagement of the locking finial from the harp assembly.

It is an object of the invention to provide a new and improved lamp that is well suited for use in institutional housing settings, but that contributes to a warm, home-like setting and feel in use.

It is a further object of the invention to provide a new and improved lamp that is durable in use while maintaining the appearance of a lamp suitable for use in a home.

It is a further object of the invention to provide a new and improved lamp that is not readily disassembled by unauthorized personnel.

It is a further object of the invention to provide a new and improved lamp that is durable but economical in manufacture.

It is a further object of the invention to provide a new and improved lamp that is convenient for use by residents whose mobility or dexterity may be impaired.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DESCRIPTION OF THE PREFERRED EMBODIMENT

Figure 1:
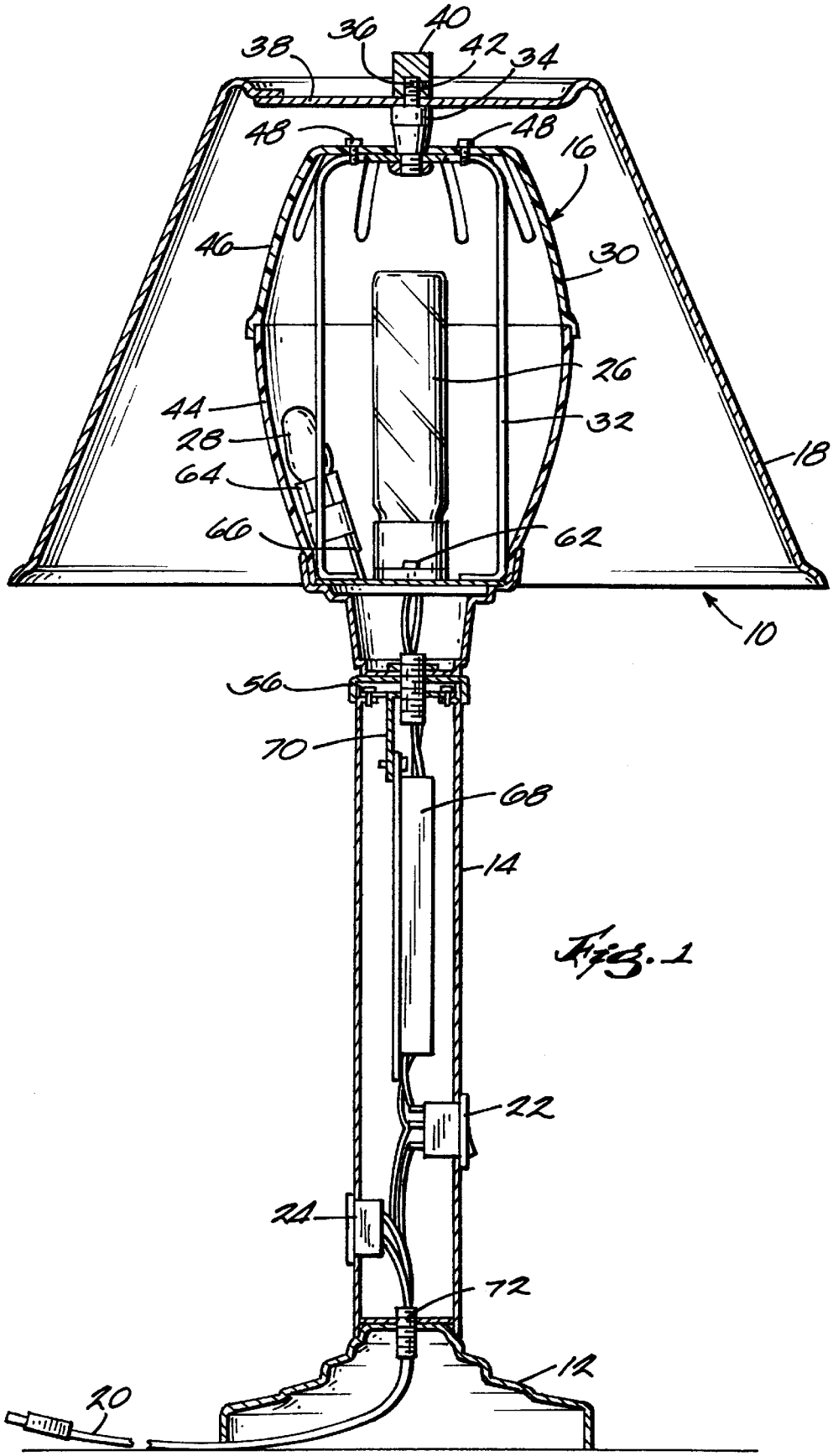
FIG. 1 is a front sectional view of an institutional lamp embodying various features of the invention.
Figure 2:
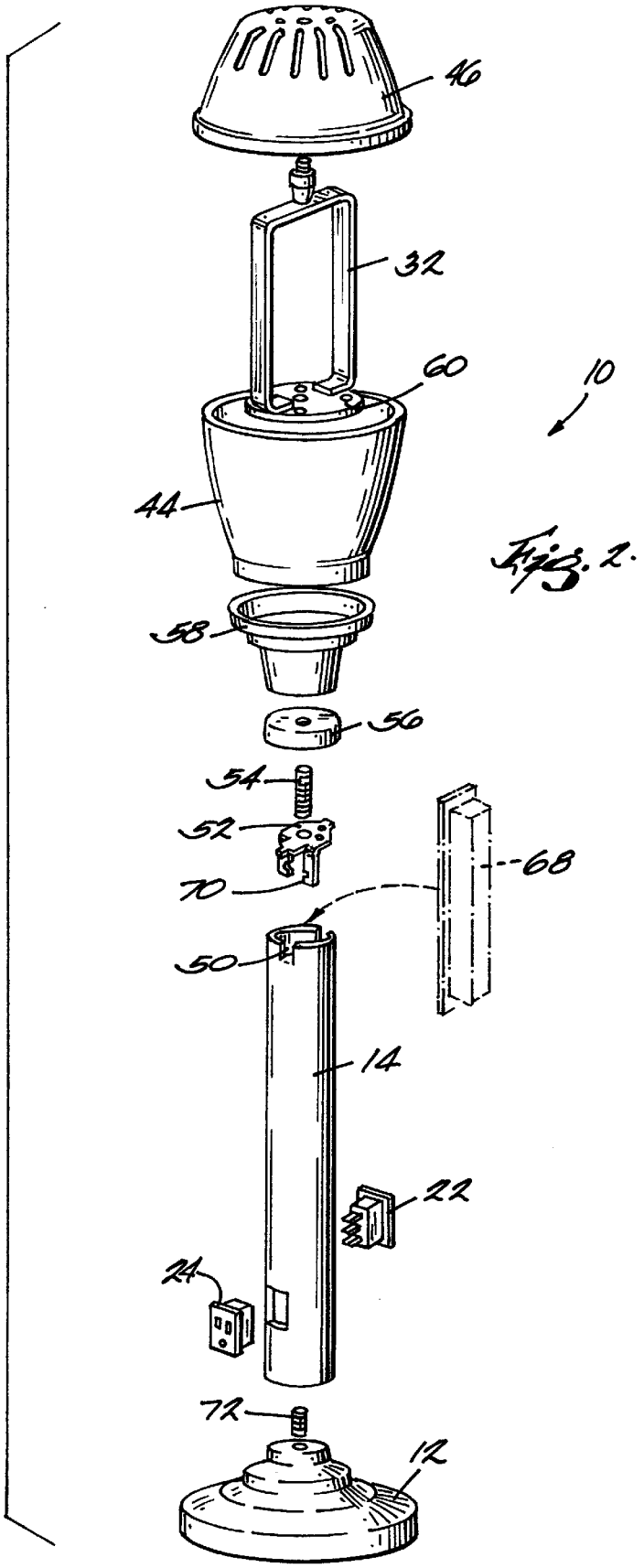
FIG. 2 is an exploded perspective view of the lamp shown in FIG. 1.

Referring to FIGS. 1 and 2, an institutional lamp 10 embodying various features of the invention is shown. The lamp 10 takes the form of a table lamp having a circular base 12, a cylindrical column 14 extending upwardly from the base 12, a lighting assembly 16 at the upper end of the column 14 and a frusto-conical lamp shade 18 around the lighting assembly 16. A power cord 20 extends from the base 12, and a switch 22 on the column 14 controls lamp operation. In accordance with one aspect of the invention, an auxiliary power socket 24 is mounted in the column 14. The auxiliary power socket 24 can be used to provide electrical power to other units, such as clocks and radios, positioned near the lamp 10.

In accordance with another aspect of the invention, the lighting assembly 16 of the lamp 10 includes a primary light source or bulb 26 and a secondary light source or bulb 28. The primary bulb 26, which can comprise an incandescent or fluorescent light bulb of known design and construction, provides sufficient light, when energized, for primary lighting. The secondary bulb 28, which preferably comprises a low wattage incandescent bulb of known design and construction, serves as a "night light" and provides a low level of light suitable for seeing in the dark without disturbing sleep. Either of the primary and secondary bulbs 26 and 28 can be energized under the control of the switch 22 or neither bulb can be energized if no light whatsoever is desired. Preferably, the switch 22 comprises a three position rocker switch that can be easily operated by people having arthritis or other physical disabilities.

In accordance with still another aspect of the invention, the lighting assembly 16 of the lamp 10 further includes a tamper resistant diffuser/guard assembly 30 that fully surrounds the primary and secondary bulbs 26 and 28. The diffuser/guard assembly 30 is preferably constructed of a durable, resilient, light transmissive material, such as an acrylic plastic, and performs two primary functions. First, the diffuser/guard assembly 30 functions to diffuse the light developed by the bulbs 26 and 28 to provide even, glare-free lighting. Additionally, the diffuser/guard functions to substantially fully enclose both bulbs 26 and 28 to prevent inadvertent contact, or unauthorized tampering, with the bulbs 26 and 28 and the electrically energized components of the lamp 10.

In the illustrated embodiment, the lighting assembly includes a harp 32 that supports both the lamp shade 18 and the diffuser/guard assembly 30. The harp 32 preferably comprises a length of metal strap that has been bent into a substantially rectangular form as shown. The harp 32 generally encircles the primary light bulb 32 and includes, at its upper end, an upwardly projecting fitting 34 that supports the lamp shade 18. The fitting includes an upwardly extending, threaded shaft 36 that extends through a support ring 38 on the shade 18, and a finial 40 threads onto the shaft 36 to secure the shade 18 to the harp 32. Preferably, the threaded shaft 36 is pivotable to enable the shade 18 to be tilted or otherwise positioned where desired. In accordance with another aspect of the invention, the finial 40 preferably includes a locking feature so that, once it is in place, it is not readily removed without the use of tools. This helps prevent casual disassembly or removal of the lamp shade 18 by unauthorized personnel. In the illustrated embodiment, the desired locking feature is provided by means of a set screw 42 that is turned by means of a hex or Allen wrench.

The diffuser/guard assembly 30 includes a lower unit or diffuser base 44 and an upper unit or diffuser cover 46. The diffuser base 44 and diffuser cover 46 interlock and form a substantially fully enclosed enclosure around the harp 32, the primary bulb 26 and the secondary bulb 28. The diffuser cover 46 includes a substantially flat upper surface that extends along and engages the flat upper portion of the harp 32. A plurality of narrow slots formed in the diffuser cover provide cooling ventilation for the bulbs 26 and 28. Preferably, one or more fasteners are used to secure the diffuser cover 46 to the harp 32. In the illustrated embodiment, a pair of screws 48 that thread into a pair of holes in the harp 32 are used to secure the diffuser cover 46 to the harp. With the diffuser cover 46 so secured and interlocked with the diffuser base 44, the diffuser/guard assembly fully encloses the bulbs 26 and 28 and avoids casual tampering or unauthorized removal of the bulbs. By removing the screws 48, however, the diffuser cover 46 is easily removed to permit replacement of the bulbs.

Referring further to the FIGS. 1 and 2, the column 14 preferably comprises a length of steel tubing. The lower end of the column 14 engages the base 12, and the upper end of the column 14 includes a pair of inwardly bent mounting tabs 50. A top mounting plate 52 is screwed or otherwise fastened to the mounting tabs 50, and a threaded mounting shaft 54 is threaded into a central aperture in the mounting plate. A check ring 56 is installed over the mounting shaft 54 and over the end of the column 14, while a harp cup 58 is placed over the check ring 56. The mounting shaft 54 extends through an opening in the lower surface of the harp cup 58, and a nut or other threaded fastener threaded onto the mounting shaft 54 secures the harp cup 58 to the top of the column 14.

The harp assembly 32 includes a harp base 60 that is screwed or otherwise fastened onto the harp cup 58 over the bottom surface of the diffuser base 44. This secures both the diffuser base 44 and the harp assembly 32 to the column 14. A first socket 62 for the primary light bulb 26 is fastened to the harp base 60, while a second socket 64 for the secondary bulb 28 is fastened to a mounting tab 66 integrally formed on the harp base 60. It will be appreciated that the socket 62 will be appropriate for the type of primary bulb (i.e., incandescent or fluorescent) used in the lamp 10. In the case of fluorescent bulbs, a ballast 68 is disposed within the column 14 and is mounted to a pair of mounting tabs 70 integrally formed with, and depending downwardly from, the mounting plate 52.

In accordance with another aspect of the invention, the shade 18 is preferably formed of a molded, durable, translucent plastic such as polystyrene. It has been found, through experience, that lamp shades are particularly subject to damage in institutional settings and that a plastic lampshade greatly increases the effective life of the lamp 10. The shade can be smooth or pleated depending on the style of lamp and can include a molded-in, cloth-like texture to further enhance the home-like appearance of the lamp 10.

In the illustrated embodiment, the column 14 is secured to the base 12 by means of a threaded shaft 72. If it is desired to secure the lamp 10 to a surface, such as a desk or dresser top, the shaft 72 can be made sufficiently long as to project through a hole formed in the surface. A nut or similar threaded fastener can then be used to secure the lamp 10 to the surface.

While a particular embodiment of the invention has been shown and described, it will be obvious to those skilled in the art that changes and modifications can be made without departing from the invention in its broader aspects, and, therefore, the aim in the appended claims is to cover all such changes and modifications as fall within the true spirit and scope of the invention.

I claim:

1. A tamper resistant lamp comprising:

a support;

a light bulb mounted in a socket which is affixed to the support;

a harp assembly mounted on and affixed to the support adjacent the light bulb for supporting a lampshade;

a lampshade removably supported on said harp assembly, and, a rigid, light transmissive, diffuser/guard assembly coupled to the harp and substantially fully enclosing the light bulb for resisting unauthorized access to the light bulb while permitting the passage of light through the diffuser/guard assembly, said assembly including a base portion affixed to said support adjacent to said socket and extending above said socket and a removable upper portion removably coupled to said base portion, said upper portion being removably affixed to said harp by means of a removable mechanical fastener.

2. A tamper resistant lamp as defined in claim 1 wherein said base portion is disposed under the light bulb and said upper portion interfits with said base portion, and is detachable therefrom when said upper portion is disconnected from said harp.

3. A tamper resistant lamp as defined in claim 2 wherein the upper portion is coupled to the harp by means of screws.

4. A tamper resistant lamp as defined in claim 3 wherein the diffuser/guard assembly is formed of translucent plastic.

5. A lamp according to claim 1 comprising:

a primary light bulb disposed within the diffuser/guard assembly;

a secondary light bulb also disposed within the diffuser/guard assembly and operable to develop a lesser quantity of light than the primary light bulb; and an electrical switch operable to selectively actuate either or none of the primary and secondary light bulbs.

6. A lamp as defined in claim 5 wherein the lamp further includes, within the diffuser/guard assembly, a first socket for receiving the primary light bulb and a second socket for receiving the secondary light bulb.

7. A lamp as defined in claim 6 wherein the electrical switch comprises a three position rocker switch.

8. An institutional lamp comprising:

a base;

a support column extending upwardly from the base;

a harp assembly affixed to the support column opposite the base;

a primary light bulb disposed adjacent the harp assembly;

a secondary light bulb also disposed adjacent the harp assembly and operable to develop a lesser quantity of light than the primary light bulb;

an electrical switch operable to selectively actuate either or none of the primary and secondary light bulbs;

a rigid, light transmissive, diffuser/guard assembly substantially fully enclosing the primary and secondary light bulbs for resisting unauthorized access to the light bulbs while permitting the passage of light through the diffuser/guard assembly, said assembly including a lower portion affixed to the support column and disposed under and around the primary and secondary light bulbs and an upper portion disposed over the light bulbs in detachable interlocking relationship to the lower portion and being removably affixed to said harp assembly;

a lampshade mounted to the harp assembly substantially encircling the diffuser/guard assembly; and a locking finial engaging the harp assembly for securing the lampshade to the harp assembly, the locking finial including a locking element for resisting unauthorized disengagement of the locking finial from the harp assembly, and a fastener removably securing the upper portion to the harp assembly.

9. An institutional lamp as defined in claim 8 wherein the diffuser/guard assembly is formed of translucent plastic.

10. An institutional lamp as defined in claim 9 wherein the electrical switch is disposed on the column.

11. An institutional lamp as defined in claim 10 wherein the lamp further includes, within the diffuser, a first socket for receiving the primary light bulb and a second socket for receiving the secondary light bulb.

12. An institutional lamp as defined in claim 11 wherein the electrical switch comprises a three position rocker switch.

13. An institutional lamp as defined in claim 12 further comprising an accessory electrical socket located on the column.

* * * * *